US012605603B2

(12) United States Patent
Kobayashi et al.

(10) Patent No.: US 12,605,603 B2
(45) Date of Patent: Apr. 21, 2026

(54) GOLF CLUB AND WEIGHT MEMBER THEREFOR

(71) Applicant: SUMITOMO RUBBER INDUSTRIES, LTD., Hyogo (JP)

(72) Inventors: Akihiko Kobayashi, Kobe (JP); Hiroshi Hasegawa, Kobe (JP)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 941 days.

(21) Appl. No.: 17/852,735

(22) Filed: Jun. 29, 2022

(65) Prior Publication Data

US 2023/0001275 A1 Jan. 5, 2023

(30) Foreign Application Priority Data

Jun. 30, 2021 (JP) ..... 2021-109149

(51) Int. Cl.
*A63B 60/24* (2015.01)
*A63B 53/14* (2015.01)
*A63B 53/04* (2015.01)

(52) U.S. Cl.
CPC ..... *A63B 60/24* (2015.10); *A63B 53/14* (2013.01); *A63B 2053/0491* (2013.01)

(58) Field of Classification Search
CPC ..... A63B 60/24; A63B 60/54; A63B 53/14; A63B 53/10; A63B 53/08; A63B 2053/0491
See application file for complete search history.

(56) References Cited

U.S. PATENT DOCUMENTS

2015/0258398 A1* 9/2015 Knutson et al. ..... A63B 53/14
2017/0182389 A1* 6/2017 Golden et al. ..... A63B 60/24
2020/0338408 A1 10/2020 Takeuchi

FOREIGN PATENT DOCUMENTS

JP 6601584 B1 11/2019

* cited by examiner

*Primary Examiner* — David L Lewis
(74) *Attorney, Agent, or Firm* — GREENBLUM & BERNSTEIN, P.L.C.

(57) ABSTRACT

A golf club comprises a tubular shaft and a weight member. The shaft has a first end having a first inner diameter and a second end on the opposite side thereof. The weight member is attached to the first end, and comprises an insertion portion disposed in the hollow of the shaft, an engaging portion engaged with the first end on the outside of the shaft, protrusions protruding radially from the insertion portion. Each protrusion has a tapered portion in which the radially outwardly protruding height from the insertion portion is decreased toward the second end. The length of each tapered portion is more than 50% of the maximum length of the protrusion, both measured in the shaft axial direction.

17 Claims, 9 Drawing Sheets

GOLF CLUB AND WEIGHT MEMBER THEREFOR

BACKGROUND OF THE INVENTION

Field of the Invention

The present disclosure relates to a golf club and a weight member therefor.

Background Art

The club balance of a golf club affects the golfer's swing, and depending on the abilities of golfers, the club balance suitable for each golfer differs.

The following Patent Document 1 discloses a golf club in which a weight member for adjusting the club balance is attached to an end of the club shaft. The club balance suitable for a golfer differs depending on the ability of the golfer.

Patent Document 1: Japanese Patent No. 6601584

SUMMARY OF THE INVENTION

Problems to be Solved by the Invention

When a golf club as described above is industrially manufactured, in order to mount the weight member in the hollow of the shaft, the outer diameter of the weight member needs to be formed with high accuracy so as to match the inner diameter of the hollow of the shaft.

On the other hand, such weight member makes it difficult to insert the weight member into the hollow of the shaft, which deteriorates the productivity. Further, the weight member needs to be stably held in the hollow of the shaft even when it receives an impact force at the time of hitting a ball.

The present disclosure is therefore, made in view of the above circumstances, and a primary objective of the present disclosure is to provide a golf club in which a weight member is stably held in a club shaft without deteriorating the productivity.

Means for Solving the Problems

According to the present disclosure, a golf club comprises a tubular shaft and a weight member, wherein the shaft is provided with a hollow therein and has a first end having a first inner diameter D1 and a second end on the opposite side of the first end, and the weight member is attached to the first end, and comprises an insertion portion disposed in the hollow, an engaging portion which is, on the outside of the shaft, engaged with the first end, a plurality of protrusions protruding radially of the shaft from the insertion portion, each of the protrusions is made of an elastically deformable material, the outer diameter D2 of the insertion portion is smaller than the first inner diameter D1 of the shaft, the maximum outer diameter D3 of the insertion portion including the protrusions is larger than the first inner diameter D1, each of the protrusions has a tapered portion in which the radially outwardly protruding height of the protrusion from the insertion portion is decreased toward the second end, the length $L_t$ of each tapered portion measured along the axial direction of the shaft is more than 50% of the maximum length L of the protrusion measured along the axial direction of the shaft, and in a state of the weight member which is attached to the shaft by inserting the insertion portion in the hollow, each of the protrusions at least partially contacts the inner surface of the shaft in a state of being compressively elastically deformed.

Effects of the Invention

Therefore, according to the present disclosure, the weight member can be stably held in the shaft without deteriorating the productivity of the golf club.

DETAILED DESCRIPTION OF THE INVENTION

Figure 1:
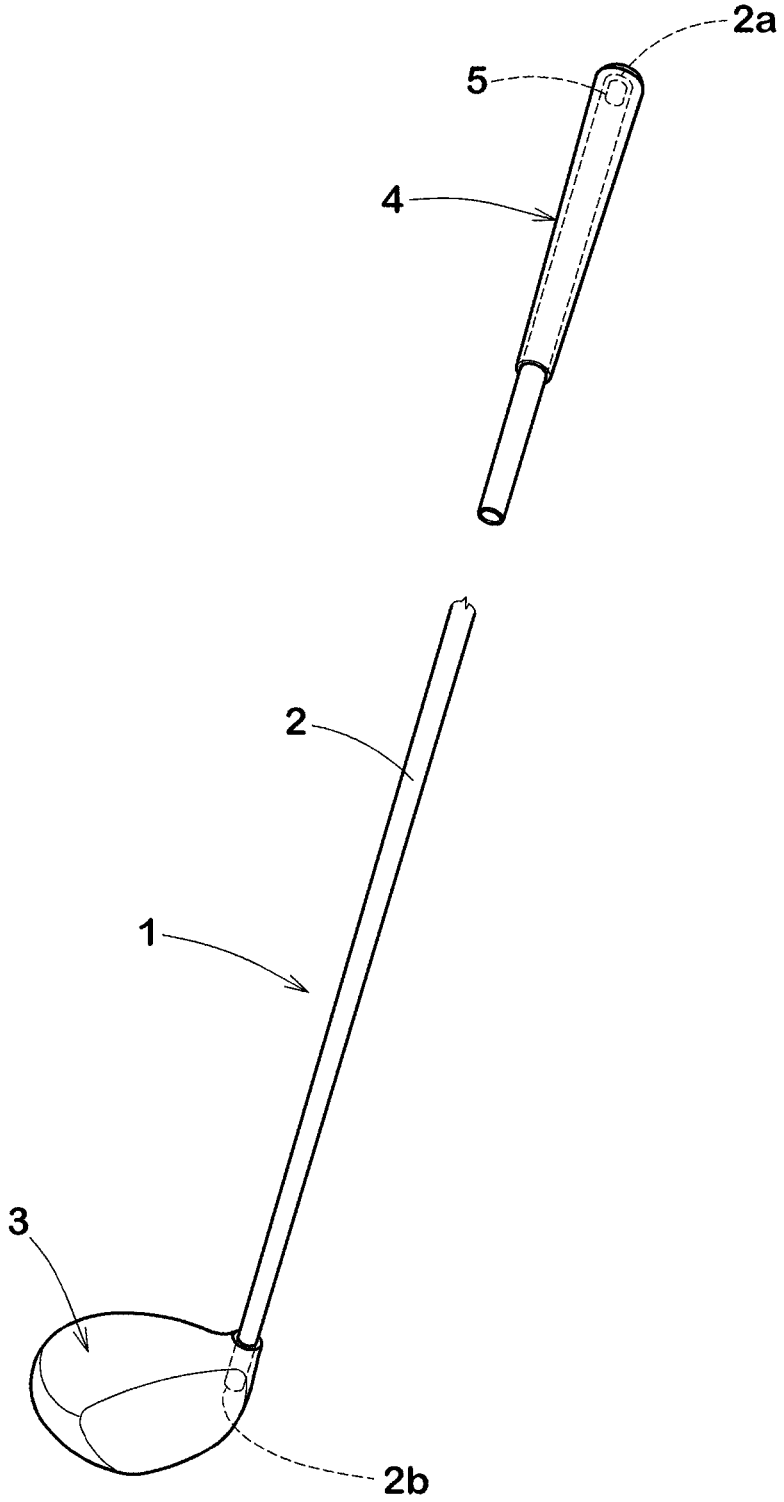
FIG. 1 is a perspective view of a golf club as an embodiment of the present disclosure.

Embodiments of the present disclosure will now be described in detail in conjunction with accompanying drawings.

Throughout the description, the same or common elements of the embodiments are designated by the same reference numeral, and redundant explanations are omitted.

FIG. 1 is a perspective view of a golf club 1 showing an embodiment of the present disclosure. As shown in FIG. 1, the golf club 1 comprises a shaft 2, a golf club head 3, a grip 4, and a weight member 5.

<Shaft>

Figure 2:
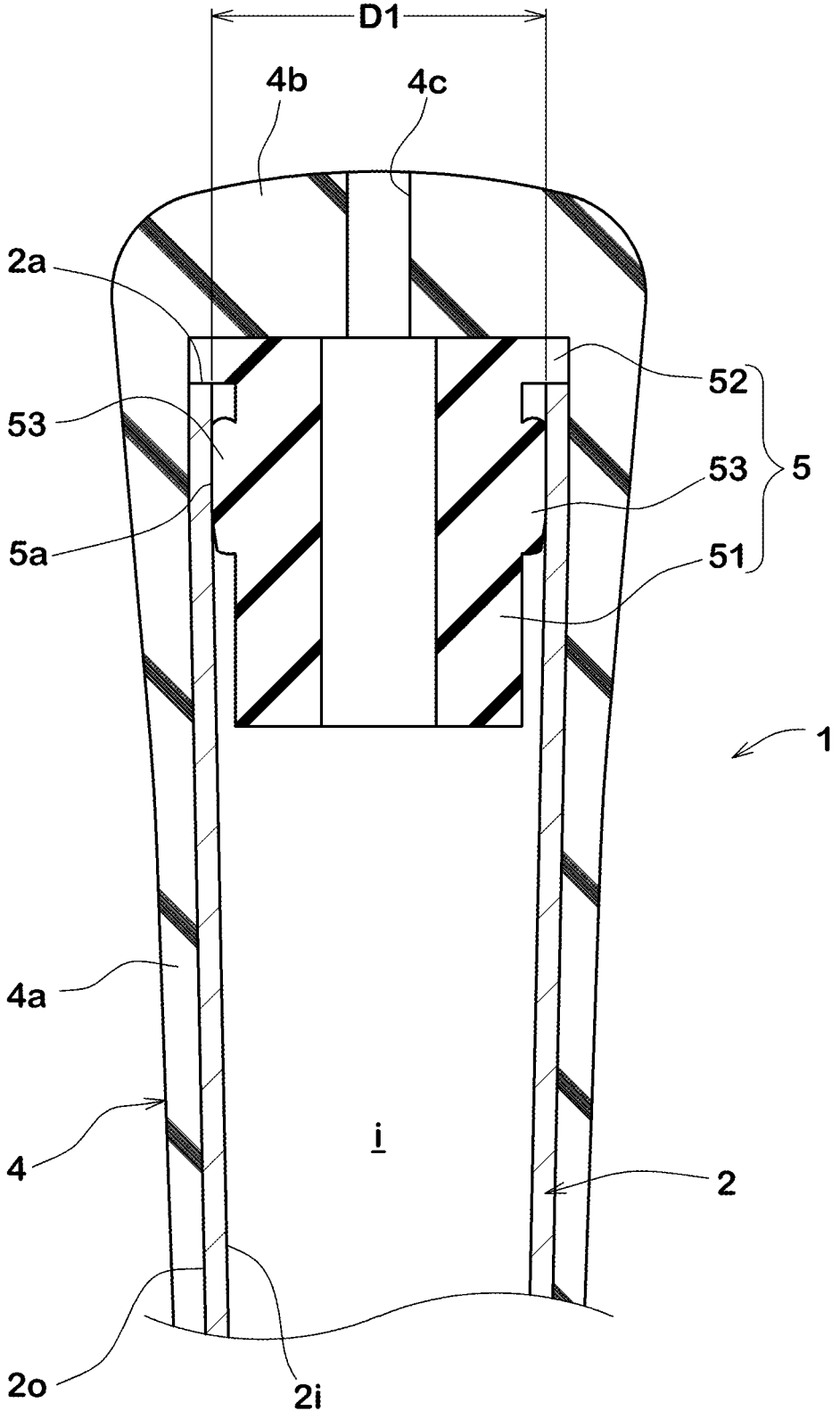
FIG. 2 is a cross-sectional partial view of the golf club showing the grip end.

FIG. 2 shows a cross-sectional view (including the shaft center line) of the end portion of the grip 4 shown in FIG. 1.

As shown in FIGS. 1 and 2, the shaft 2 is formed in the form of a pipe having a hollow (i) therein.

In the cross sections of the shaft 2 which are orthogonal to the shaft axial direction, the outer peripheral surface 2*o* and inner surface 2*i* of the shaft 2 are circular, therefore, the shaft 2 is formed in the form of a hollow circular cylinder. The shaft 2 in this example is made of a fiber reinforced resin. However, as another example, the shaft 2 may be made of a metallic material.

The shaft 2 has a first end 2*a* and a second end 2*b* on the opposite side thereto in the axial direction of the shaft.

The first end 2*a* of the shaft 2 has a first inner diameter D 1. For example, the first inner diameter D 1 is about 12 to 16 mm.

In this embodiment, the first end 2*a* of the shaft 2 has an outer diameter and an inner diameter larger than those of the second end 2*b*. However, the shaft 2 may be configured with a constant outer diameter and inner diameter over the entire length.

<Golf Club Head>

As shown in FIG. 1, the golf club head 3 has a striking surface for hitting a ball. The golf club head 3 is fixed to the second end 2*b* of the shaft 2. For example, the golf club head 3 is configured as a wood type head. But, the golf club head 3 may be configured as an iron type head, a hybrid type head or a putter type head.

<Grip>

As shown in FIG. 1, the grip 4 is attached to the first end 2*a* of the shaft 2. As shown in FIG. 2, the grip 4 in this example comprises

- a grip portion 4*a* to be gripped by a golfer, and
- a rear/butt end portion 4*b* provided on one end side of the grip portion 4*a*.

The grip portion 4*a* is tapered toward the other end of the grip portion 4*a* on the opposite side to the rear/butt end portion 4*b* and has a substantially circular cylindrical outer shape. The other end is provided with an opening into which the shaft 2 can be inserted.

The rear/butt end portion 4*b* covers the first end 2*a* of the shaft 2. The rear/butt end portion 4*b* is provided with a through hole 4*c* communicating with the inside of the grip 4 for exhausting air when the shaft 2 is inserted in the grip 4.

<Weight Member>

In the present embodiment, as shown in FIGS. 1 and 2, the weight member 5 is attached to the first end 2*a* of the shaft 2, namely, the weight member 5 is provided on the opposite side of the shaft 2 to the golf club head 3. Such weight member 5 is useful, for example, to provide a counterbalanced golf club 1.

Hereinafter, regarding the weight member 5, one of two sides in the shaft axial direction on the first end 2*a* side may be referred to as the "posterior end side", and the other of the two sides on the second end 2*b* side may be referred to as the "anterior end side".

Incidentally, the weight member has a center line which coincides with the shaft center line when attached to the shaft, therefore, when the weight member alone is described, the shaft center line can be read as the center line of the weight member. Further, the axial direction of the shaft and the circumferential direction of the shaft can be read as the axial direction of the weight member and the circumferential direction of the weight member, respectively.

The weight member 5 in the present embodiment comprises

- an insertion portion 51 disposed in the hollow (i) of the shaft 2,
- an engagement portion 52 which is, on the outside of the shaft 2, engaged with the first end 2*a*, and
- a plurality of protrusions 53 which protrude from the insertion portion 51 radially of the shaft center line.

<Insert Portion>

Figure 3:
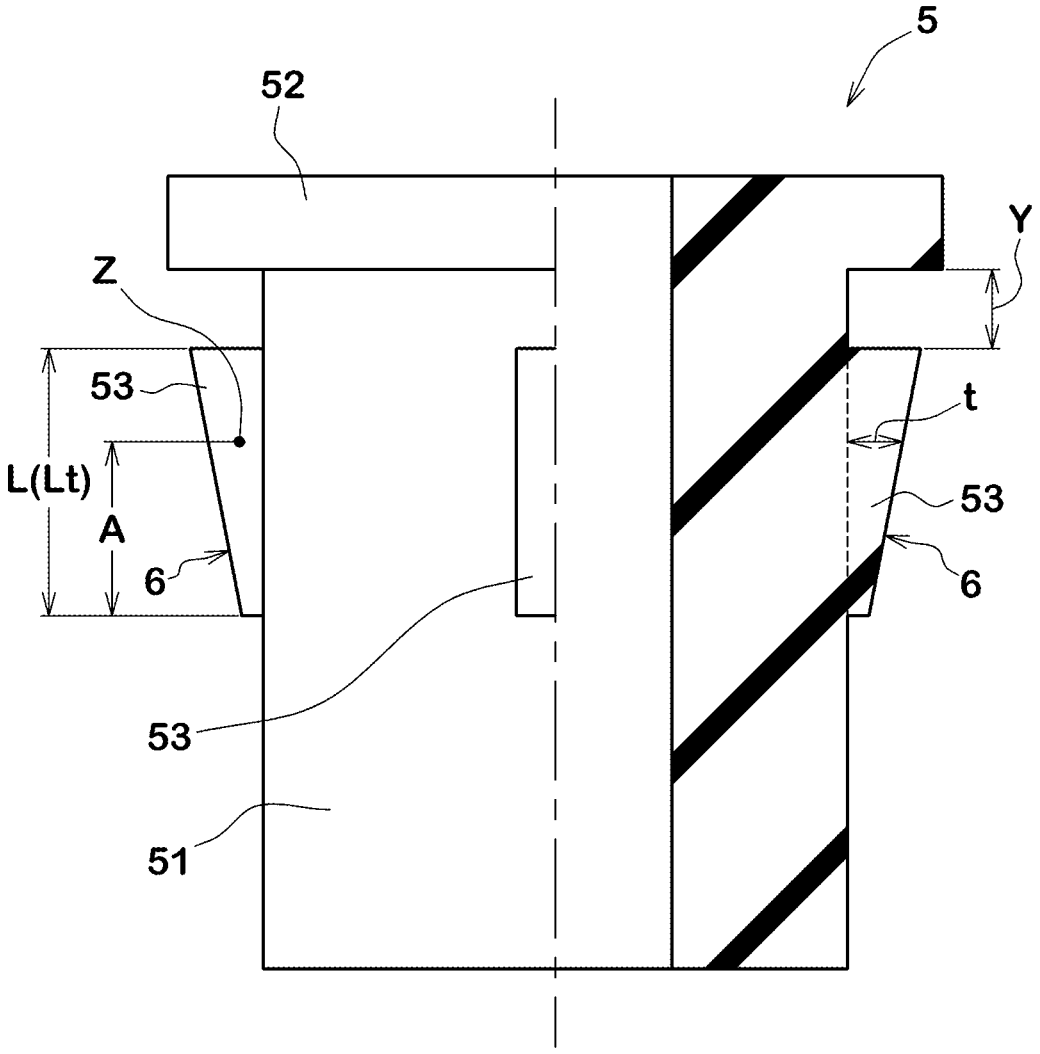
FIG. 3 is a side view of a weight member showing an embodiment of the present disclosure.
Figure 4:
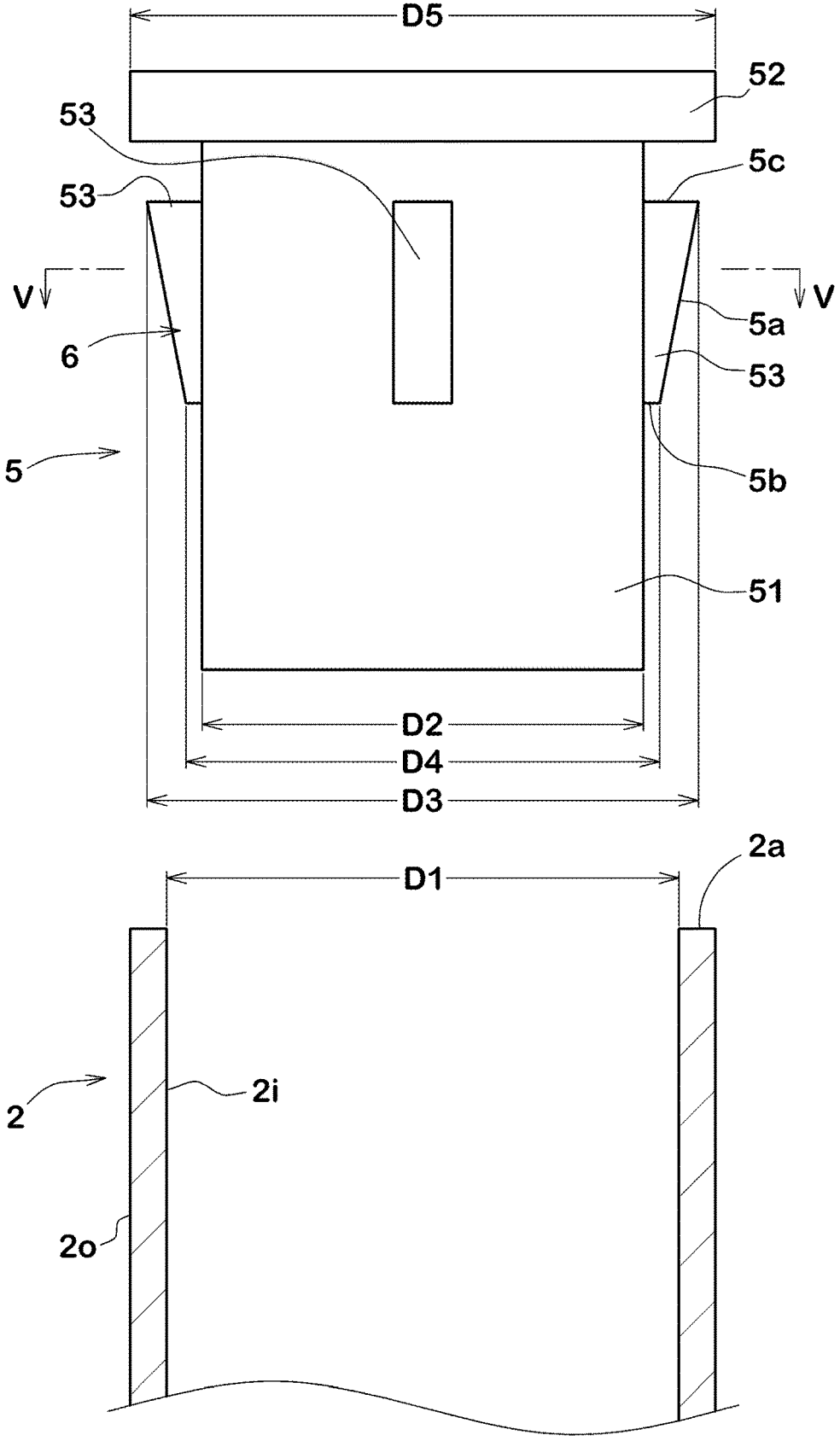
FIG. 4 separately shows the weight member and the end portion of the shaft, as a side view and a cross-sectional partial view, respectively.
Figure 5:
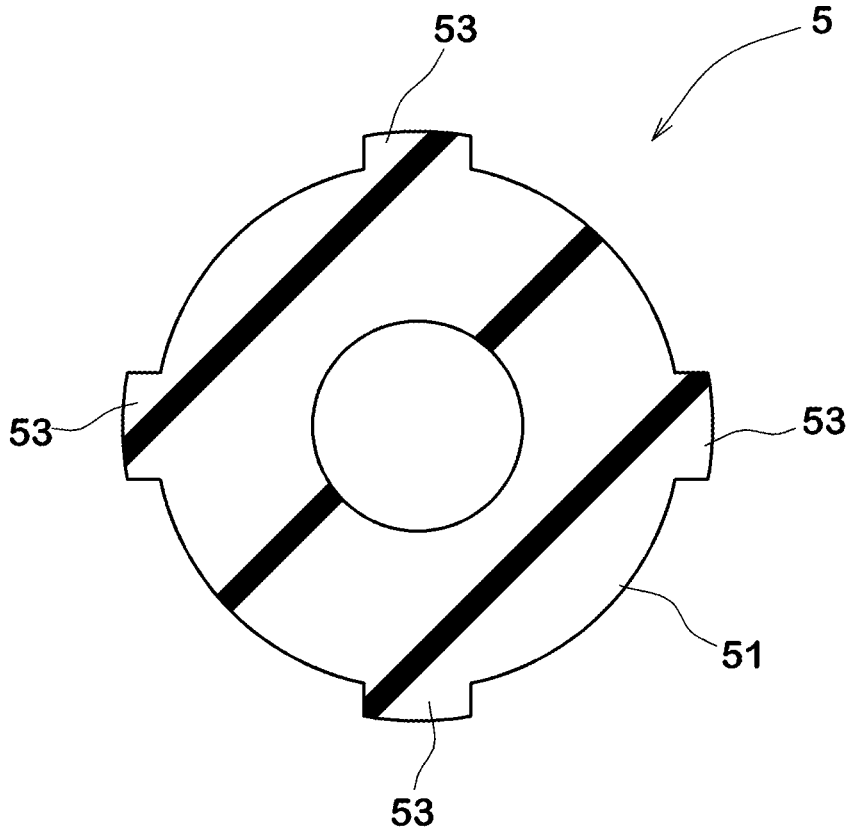
FIG. 5 is a cross-sectional view taken along line V-V of FIG. 4.

FIG. 3 is a side view of the weight member 5 not yet attached to the shaft 2. FIG. 4 shows the weight member 5 and the end portion of the shaft 2 separately by aligning their center lines. FIG. 5 is a sectional view taken along line V-V of FIG. 4.

As shown in FIGS. 3 to 5, the insertion portion 51 is a heavy object having a length in the shaft axial direction.

The insertion portion 51 in the present embodiment is formed in the form of a hollow circular cylinder. But, the insertion portion 51 may be formed in the form of a solid circular column or a solid polygonal column.

Although not particularly limited, preferably, the mass of the weight member 5 is about 1 to 100 g, for example.

In the state of the insertion portion 51 not yet inserted in the shaft 2, the outer diameter D2 (FIG. 4) of the insertion portion 51 (not including the protrusion 53) is smaller than the first inner diameter D1 of the first end 2*a* of the shaft 2.

The outer diameter D2 of the insertion portion 51 may be constant or may vary in the shaft axial direction. When the outer diameter of the insertion portion 51 varies, the outer diameter D2 means the maximum outer diameter.

<Engaging Portion>

The engaging portion 52 is formed so as to project radially outwardly at the end on the posterior end side, of the insertion portion 51, for example. As shown in FIG. 4, the engaging portion 52 in the present embodiment is formed in the form of a circular flange having an outer diameter D5 larger than the first inner diameter D1 of the first end 2*a* of the shaft 2.

Therefore, as shown in FIG. 2, the engaging portion 52 butts with the end surface of the first end 2*a*, and is kept outside the shaft 2.

Preferably, the engaging portion 52 is sandwiched and held between

- the end surface of the first end 2*a* of the shaft 2 and
- the inner surface of the rear/butt end portion 4*b* of the grip 4.

As another example of the engaging portion 52, the engaging portion 52 may be made up of a plurality of portions projecting radially outward of the inserting portion 51.

<Protrusions>

In the present embodiment, the protrusions 53 are arranged around the insertion portion 51 at positions on the engaging portion 52 side of the tip of the inserting portion 51 in the shaft axial direction.

The protrusions 53 are spaced apart from the engaging portion 52 by a distance Y in the shaft axial direction.

The protrusions 53 are preferably arranged at equal intervals in the circumferential direction of the shaft as shown in FIG. 5.

Each of the protrusions 53 is made of an elastically deformable material, preferably a rubber-like elastic material.

The rubber-like elastic material has rubber elasticity, and includes vulcanized rubber and resin-based elastomers.

In the present embodiment, the protrusions 53 are made of vulcanized rubber. In the present embodiment, the protrusions 53 as well as the insertion portion 51 and the engagement portion 52 are made of a rubber-like elastic material.

In order to provide a larger weight, a metal material or the like may be embedded in the insertion portion 51 although such example is not shown.

As shown in FIG. 4, in the state where the weight member 5 is not yet mounted in the shaft 2, the maximum outer diameter D3 of the insertion portion 51 including the protrusions 53 is larger than the first inner diameter D1 of the first end 2*a* of the shaft 2.

Here, the "maximum outer diameter D3 of the insertion portion 51 including the protrusions 53" is equal to twice the distance in the radial direction of the shaft from the central axis line of the insertion portion 51 to the radially outermost position of each protrusion 53.

As shown in FIGS. 3 and 4, in the state where the weight member 5 is not yet mounted in the shaft 2, each of the protrusions 53 comprises a tapered portion 6.

In the tapered portion 6, its protruding height (t) measured in the radial direction of the shaft from the insertion portion 51 is decreased toward the second end 2*b* side of the shaft 2.

In the weight member 5 in the present embodiment, the length $L_t$ of the tapered portion 6 measured in the shaft axial direction is set to be larger than 50%, preferably not less than 95%, more preferably substantially 100% of the maximum length L of the protrusion 53 measured in the shaft axial direction.

<Function of the Weight Member of the Present Embodiment>

In the weight member 5 configured as described above, since the outer diameter D2 of the insertion portion 51 is smaller than the first inner diameter D1 of the shaft, the insertion portion 51 can be easily inserted into the hollow (i) of the shaft 2 from the first end 2*a* side of the shaft 2. This facilitates the work process of inserting the weight member 5 into the hollow (i) of the shaft 2, and helps to improve the productivity of the golf club 1.

In order to enhance such function, it is preferred that the difference between the outer diameter D2 and the first inner diameter D1 is set to be about 0.10 to 0.15 mm although the difference is not particularly limited.

When the insertion portion 51 of the weight member 5 is further inserted into the hollow (i) of the shaft 2, the engaging portion 52 butts with the first end 2*a* on the outside of the shaft 2, and the insertion portion is positioned at its place.

Thus, this makes it always possible to mount the weight member 5 at the fixed correct position with respect to the shaft 2, and helps to keep the balance of the golf club 1 constant.

Further, the weight member 5 is formed so that the maximum outer diameter D3 of the insertion portion 51 including the protrusions 53 is larger than the first inner diameter D1 of the shaft 2. Therefore, as shown in FIG. 2, in the state where the weight member 5 has been mounted in the shaft 2, at least a part of each of the protrusions 53 contacts the inner surface 2*i* of the shaft 2 in a state of being compressively elastically deformed.

Therefore, due to the frictional force and normal force between the protrusions 53 and the inner surface 2*i* of the shaft 2, the weight member 5 is stably held in the circumferential direction, axial direction and radial direction of the shaft.

Further, in the protrusions 53 of the present embodiment, since the length $L_t$ of the tapered portion 6 is larger than 50% of the maximum length L of the protrusion 53, each protrusion 53 can contact the inner surface 2*i* of the shaft 2 in a wider range to generate great holding power, without deteriorating the insertion workability into the shaft 2.

Further, in the protrusions 53 in the present embodiment, due to the shape of each protrusions 53, the center of gravity of each protrusion 53 is relatively sifted to the first end 2*a* side of the weight member 5.

This makes it possible to shift the position of the center of gravity of the weight member 5 toward the first end 2*a* of the shaft 2, and thus enhance the counterbalance effect on the golf club 1.

<Preferable Configuration>

Figure 6:
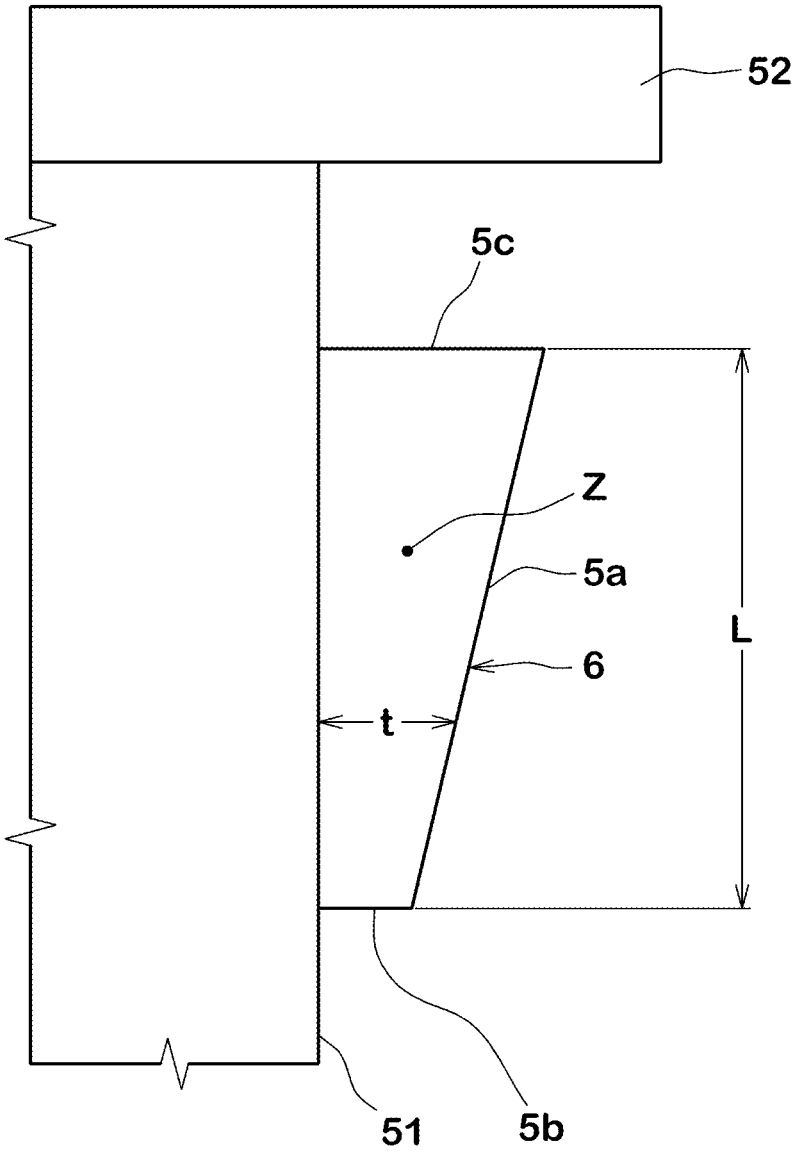
FIG. 6 is a partial side view of the weight member showing the side view of a protrusion.

FIG. 6 shows a side view of the protrusion 53. It is preferable that, in the state of the weight member 5 not yet mounted in the shaft 2, the centroid Z of each of the protrusions 53 is positioned on the first end 2*a* side of the middle position in the shaft axial direction of the maximum length L of the protrusion 53 measured in the shaft axial direction. As a result, the center of gravity of the weight member 5 can be more reliably positioned toward the first end 2*a* of the shaft 2, and the counterbalance effect on the golf club 1 can be further enhanced.

The distance Y (FIG. 3) in the shaft axial direction between the protrusion 53 and the engaging portion 52 is set to be not less than 1 mm, more preferably not less than 2 mm, for example.

The space between the protrusions 53 and the engaging portion 52 can be utilized for the protrusions 53 to make the elastic deformation. As a result, the weight member 5 can be surely stably inserted into the shaft 2 up to a position where the engaging portion 52 comes into contact with the end surface of the first end 2*a* of the shaft 2.

As shown in FIG. 6, the protrusion 53 has a first surface 5*a* facing the inner surface 2*i* of the shaft 2.

In the present embodiment, the entire first surface 5*a* is inclined with respect to the shaft axial direction and forms the tapered portion 6 tapered toward the second end 2*b* side of the shaft 2.

In the present embodiment, the protrusion 53 has a second surface 5*b* and a third surface 5*c* on both sides in the shaft axial direction, of the first surface 5*a*.

The second surface 5*b* defines the end of the protrusion 53 on the taper tip end side.

In the present embodiment, the second surface 5*b* is substantially parallel to a radial direction determined at the circumferential position of the protrusion 53 concerned. Here, the expression "substantially parallel" means that an inclination of up to 5 degrees is allowed.

In the present embodiment, at the position in the shaft axial direction, of the second surface 5*b*, the protruding height (t) of the protrusion 53 is the minimum. Although not particularly limited, it may be possible to set the outer diameter D4 of the insertion portion 51 including the protrusions 53, at the position in the shaft axial direction, of the second surface 5*b*, to be smaller than the first inner diameter D1 of the shaft 2. In this case, when the weight member 5 is inserted into the hollow (i) of the shaft 2, the insertion can be prevented from being hindered by the contact between the second surface 5*b* and the end surface of the first end 2*a* of the shaft 2, and the even smoother insertion work is possible.

The third surface 5*c* defines the end of the protrusion 53 on the taper butt end side.

In the present embodiment, the third surface 5*c* is substantially parallel to a radial direction determined at the circumferential position of the protrusion 53 concerned. Here, again the expression "substantially parallel" means that an inclination of up to 5 degrees is allowed.

In the present embodiment, at the position in the shaft axial direction, of the third surface 5*c*, the protruding height (t) of the protrusion 53 is the maximum.

The outer diameter of the insertion portion 51 including the protrusions 53 at the position in the shaft axial direction, of the third surface 5*c* defines the above-mentioned maximum outer diameter D3. In this case, when the weight member 5 is inserted into the hollow (i) of the shaft 2, at least a part of the protrusion 53 in the vicinity of the third surface 5*c* can be elastically compressed and deformed.

However, it is preferable that, in the state of the weight member 5 mounted in the shaft 2, the entire first surfaces 5*a* of the protrusions 53 come into contact with the inner surface 2*i* of the shaft 2 as shown in FIG. 2. In this case, a large contact area can be secured between the tapered portions 6 of the protrusions 53 and the inner surface 2*i* of the shaft 2, and the weight member 5 can be firmly held on the inner surface 2*i* of the shaft 2.

Such configuration or design can be easily realized by adjusting the maximum outer diameter D3 of the weight member 5 in relation to the first inner diameter D1 of the shaft 2, and the taper angle of the tapered portion 6.

In the golf club 1 in the present embodiment, it is preferable that the compression deformation rate of the protrusion 53 is set in a range from 1% to 25%.

The compression deformation rate is given by the following expression (1):

$$(D3-D1)/D3\times100$$

wherein

D1 is the above-mentioned first inner diameter of the shaft 2, and

D3 is the above-mentioned maximum outer diameter of the insertion portion 51 including the protrusion 53.

By setting the compression deformation rate within the above-mentioned range, it is possible to optimize the work of inserting the weight member 5 into the shaft 2 and the holding force of the weight member 5 at the same time.

When the compression deformation rate is less than 1%, the holding force of the weight member 5 with respect to the shaft 2 tends to become small, therefore, as the golf curb is used, the weight member 5 may fall off or make an abnormal noise during swinging.

From this point of view, the compression deformation rate is more preferably not less than 5%, still more preferably not less than 10%.

On the contrary, if the compression deformation rate exceeds 25%, the work of inserting the weight member 5 into the shaft 2 may become significantly difficult. From this point of view, the compression deformation rate is more preferably not more than 20%, still more preferably not more than 15%.

Further, it is preferable that the golf club 1 of the present embodiment satisfies the following conditional expression (2): $2.0\leq W/S\leq25.0$ wherein W is the mass in grams of the weight member 5, and S is the total contact area in sq·cm between the plurality of protrusions 53 and the inner surface 2*i* of the shaft 2.

The conditional expression (2) specifically limits the mass W of the weight member 5 shared by the unit contact area of the protrusions 53.

By specifying the ratio W/S in this way, even when the weight member 5 has a large mass, a large force for holding the weight member 5 can be secured to prevent it from falling off, while maintaining the smooth insertion work of the weight member 5 into the hollow (i) of the shaft 2.

If the ratio W/S is small, there is no particular problem in the stability of the weight member 5 after mounted.

The ratio W/S is set to be not less than 2.0 (g/sq·cm) for a practical reason, preferably set to be not less than 5 (g/sq·cm), more preferably not less than 10 (g/sq·cm).

If the ratio W/S exceeds 25.0 (g/sq·cm), the contact area of the protrusion 53 becomes too small for the mass of the weight member 5, and as a result, there is a possibility that the weight member 5 falls off as the golf club is used, or an abnormal noise is generated during swinging. Further, the stability of the weight member 5 after mounted may be deteriorated.

From this point of view, the ratio W/S is more preferably not more than 20 (g/sq·cm), still more preferably not more than 15 (g/sq·cm).

In order that the weight member 5 satisfies the conditional expression (2), it is possible to adjust the total area of the first surfaces 5*a* of the protrusions 53 and/or the number of the protrusions 53, taking the mass of the weight member 5 into consideration.

Figure 7A:
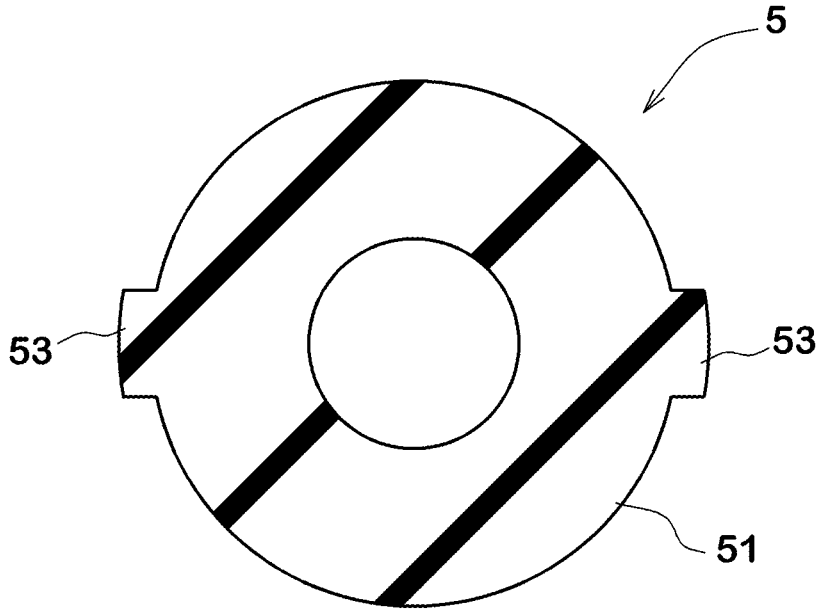
FIGS. 7A and 7B are cross-sectional views of examples of the weight member showing examples of arrangements of the protrusions.
Figure 7B:
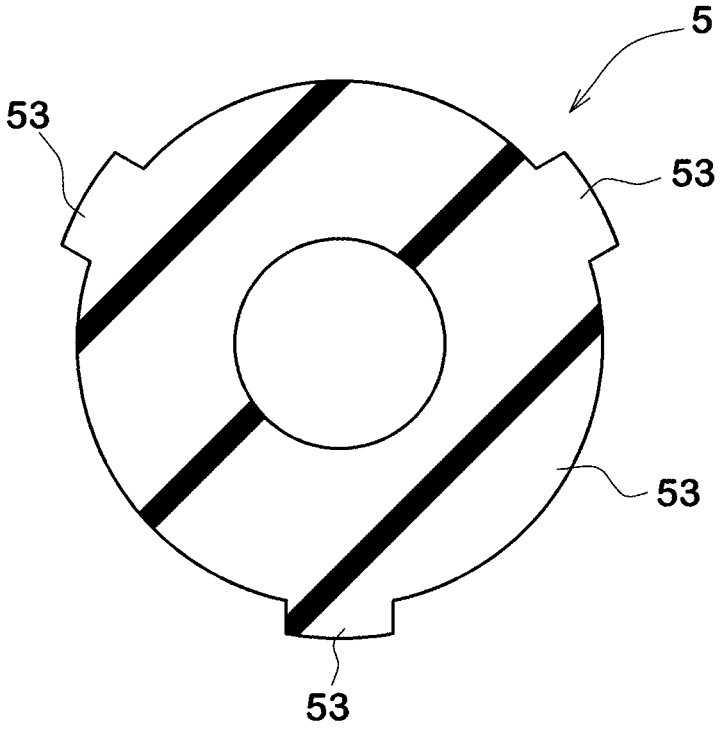

For example, when the total area of the first surfaces 5*a* is large, the number of protrusions 53 can be decreased as shown in FIG. 7A. When the total area of the first surfaces 5*a* is small, the number of protrusions 53 can be increased as shown in FIG. 7B.

<Dimensions of Protrusions, Etc.>

In order to obtain a sufficient contact area with the shaft 2, the above-mentioned maximum length L of each protrusion 53 is set to be not less than 2 mm, preferably not less than 5 mm, more preferably not less than 10 mm. Further, in order to give appropriate rigidity resisting compression to the protrusions 53, the width of each protrusion 53 is set to be not less than 2 mm, preferably not less than 4 mm, more preferably not less than 6 mm.

Here, the width is measured in the direction of the tangent line to the protrusion extending in the shaft circumferential direction.

FIGS. 8A to 8D show further examples of the shape of a side surface of the protrusion 53.

Each of FIGS. 8A to 8D is a side view in the direction orthogonal to a plane including both the shaft center line and the center of the circumferential width of the protrusion 53.

Figure 8A:
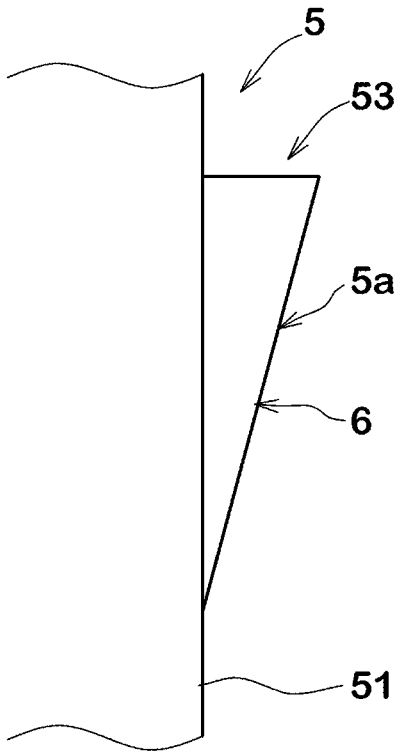
FIGS. 8A to 8D are side views of further examples of the protrusion.

In the example shown in FIG. 8A, the shape of the side surface of the protrusion 53 is triangular.

In this example, the above-mentioned second surface 5*b* on the taper tip end side is not provided in substance. Therefore, in this example, the taper tip end of the protrusion 53 is merged into the insertion portion 51 without forming a step. As a result, the durability of the protrusion 53 may be improved.

In this example, the triangular shape of the side surface is continued to the side surface on the opposite side as the cross-sectional shape of the protrusion 53. But, the cross-sectional shape may be varied between the two side surfaces, or the shape of the side surface may be different from that on the opposite side.

Figure 8B:
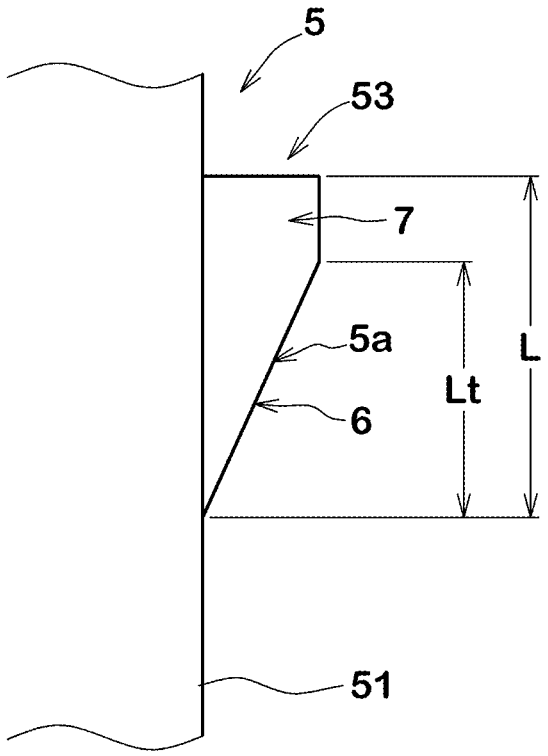

The example shown in FIG. 8B is a modification of that shown in FIG. 8A, and the shape of the side surface of the protrusion 53 is trapezoidal.

In this example, the first surface 5*a* is made up of the above-mentioned tapered portion 6 and a non-tapered portion 7.

In the non-tapered portion 7, the protruding height (t) is constant along the shaft axial direction.

In the tapered portion 6, the protruding height (t) is decreased toward the second end 2*b* side of the shaft 2 as explained above.

In this example, the above-mentioned second surface 5*b* on the taper tip end side is not provided in substance. Therefore, in this example, the taper tip end of the protrusion 53 is merged into the insertion portion 51 without forming a step. Further, in this example, the trapezoidal shape of the side surface is continued to the side surface on the opposite side as the cross-sectional shape of the protrusion 53. But, the cross-sectional shape may be varied between the two side surfaces, or the shape of the side surface may be different from that on the opposite side.

Figure 8C:
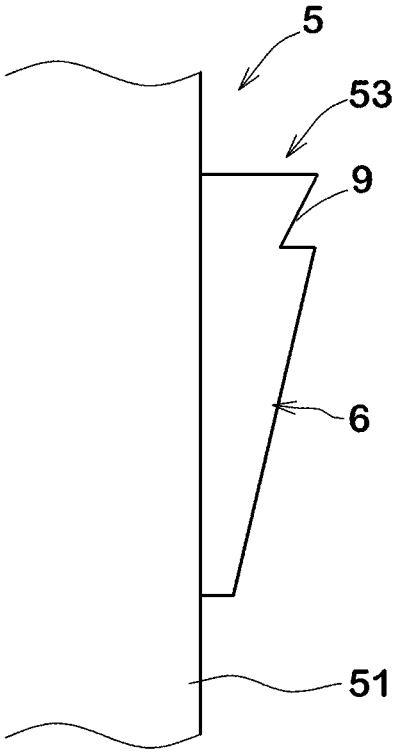
Figure 8D:
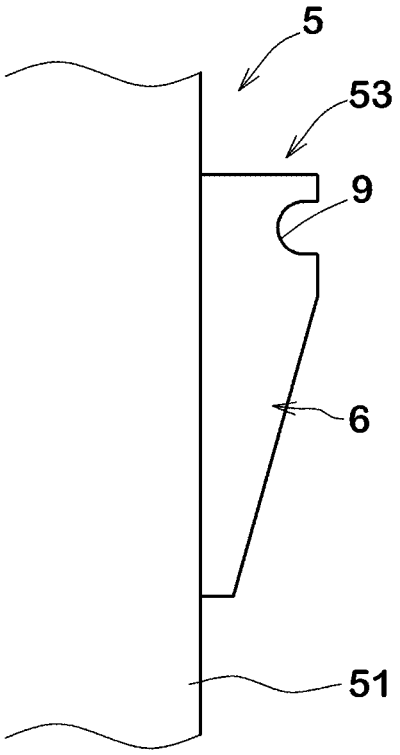

The examples shown in FIG. 8C and FIG. 8D are modifications of the protrusion 53 shown in FIGS. 3 and 6 having the second surface 5*b* and the third surface 5*c*.

and displacements in the shaft axial direction and shaft radial direction from the initial mounting position were measured.

The results are indicated in Table 1 by an index based on Example 3 being 100, wherein the smaller value is better.

TABLE 1

| | comparative example 1 | comparative example 2 | example 1 | example 2 | example 3 | example 4 | example 5 | example 6 | example 7 | example 8 |
|---|---|---|---|---|---|---|---|---|---|---|
| structure of weight member | FIG. 3 | FIG. 3 | FIG. 3 | FIG. 3 | FIG. 3 | FIG. 3 | FIG. 3 | FIG. 3 | FIG. 3 | FIG. 3 |
| presence(Y) or absence(N) of protrusions | N | Y | Y | Y | Y | Y | Y | Y | Y | Y |
| first inner diameter D1 of shaft (mm) | 14 | 14 | 14 | 14 | 14 | 14 | 14 | 14 | 14 | 14 |
| outer diameter D2 of insertion portion (mm) | 13 | 13 | 13 | 13 | 13 | 13 | 13 | 13 | 13 | 13 |
| maximum outer diameter D3 of insertion portion including protrusions (mm) | 13 | 16.5 | 14.1 | 15.2 | 16.5 | 18.7 | 19.2 | 16.5 | 16.5 | 16.5 |
| ratio Lt/L (%) | 0 | 40 | 100 | 100 | 100 | 100 | 100 | 100 | 60 | 80 |
| compression deformation rate (%) | 0 | 15 | 1 | 8 | 15 | 25 | 27 | 15 | 15 | 15 |
| mass W of weight member (g) | 8 | | | | | | | 20 | 8 | 8 |
| total contact area S between protrusions and shaft (sq. cm) | 0 | 0.8 | 0.8 | 0.8 | 0.8 | 0.8 | 0.8 | 0.8 | 0.8 | 0.8 |
| ratio W/S (g/sq. cm) | — | 10 | 10 | 10 | 10 | 10 | 10 | 25 | 10 | 10 |
| assembling workability | 140 | 140 | 90 | 95 | 100 | 110 | 120 | 100 | 125 | 120 |
| mounting stability of weight member | 130 | 100 | 120 | 110 | 100 | 95 | 90 | 110 | 100 | 100 |

In each example, the protrusion 53 is provided in the first surface 5*a*, with a groove 9 extending in the circumferential direction of the shaft.

In the example shown in FIG. 8C, the cross section of the groove 9 has a V-shaped contour shape.

In the example shown in FIG. 8D, the cross section of the groove 9 has a semicircle contour shape.

Such grooves 9 promote deformation of the protrusion 53 and helps to provide a smoother insertion operation.

The groove 9 continually extends from one of the side surfaces to the other. In these example, the shape of one of the side surfaces is continued to the side surface on the other side as the cross-sectional shape of the protrusion 53.

While detailed description has been made of preferable embodiments of the present disclosure, the present disclosure can be embodied in various forms without being limited to the illustrated embodiments.

Comparison Tests

In order to confirm the effects of the present disclosure, different kinds of weight members having specifications listed in Table 1 were experimentally manufactured, and the following tests were conducted thereon.

<Assembling Workability>

For each kind of the weight member, each of five workers inserted thirty weight members into respective shafts, and then attached identical thirty grips thereto respectively, and the total working time of each worker was obtained. Then, for each kind of the weight member, the average of the total working time of the five workers was obtained.

The results are indicated in Table 1 by an index based on Example 3 being 100, wherein the smaller value is better.

<Mounting Stability of Weight Member>

Golf clubs to which the different kinds of the weight members were respectively attached were prepared, and hit golf balls 3000 times per golf club. Then, in order to check the condition of the weight member, the grip was removed, From the test results, it was confirmed that the weight members according to the present disclosure were stably held inside the shaft without deteriorating the productivity.

Statement of the Present Disclosure

The present disclosure is as follows:

Disclosure 1: A golf club comprising a tubular shaft and a weight member, wherein the shaft is provided with a hollow therein and has a first end having a first inner diameter D1 and a second end on the opposite side of the first end, and the weight member is attached to the first end, the weight member comprises an insertion portion disposed in the hollow, an engaging portion which is, on the outside of the shaft, engaged with the first end, a plurality of protrusions protruding radially of the shaft from the insertion portion, each of the protrusions is made of an elastically deformable material, the outer diameter D2 of the insertion portion is smaller than the first inner diameter D1 of the shaft, the maximum outer diameter D3 of the insertion portion including the protrusions is larger than the first inner diameter D1, each of the protrusions has a tapered portion in which the radially outwardly protruding height of the protrusion from the insertion portion is decreased toward the second end, the length $L_t$ of each tapered portion measured along the axial direction of the shaft is more than 50% of the maximum length L of the protrusion measured along the axial direction of the shaft, and in a state of the weight member which is attached to the shaft by inserting the insertion portion in the hollow, each of the protrusions at least partially contacts the inner surface of the shaft in a state of being compressively elastically deformed.

Disclosure 2: The golf club according to Disclosure 1, wherein in each of the protrusions, the length $L_t$ of the tapered portion is not less than 95% of the maximum length L of the protrusion.

Disclosure 3: The golf club according to Disclosure 1 or 2, wherein each of the protrusions has a first surface facing the inner surface of the shaft, and the entire first surface is in contact with the inner surface of the shaft.

Disclosure 4: The golf club according to Disclosure 1, 2 or 3, wherein a compression deformation rate of the protrusion given by (D3-D1)/D3×100 is in a range from 1% to 25%, wherein D1 is said first inner diameter of the shaft, and D3 is said maximum outer diameter of the insertion portion including the protrusions.

Disclosure 5: The golf club according to Disclosure 1, 2, 3 or 4, wherein a ratio W/S of the mass W in grams of the weight member and the total contact area S in sq·cm between the plurality of protrusions and the inner surface of the shaft is not less than 2.0 but not more than 25.0.

Disclosure 6: The golf club according to any one of Disclosures 1 to 5, wherein, in a state of the weight member not mounted on the shaft, the centroid of each protrusion is positioned on the first end side of the middle position of the maximum length of the protrusion measured in the shaft axial direction.

Disclosure 7: The golf club according to any one of Disclosures 1 to 6, wherein the protrusions are arranged at equal intervals in the circumferential direction of the shaft.

Disclosure 8: The golf club according to any one of Disclosures 1 to 7, wherein each of the protrusions is spaced apart from the engaging portion by a distance Y in the shaft axial direction, and the distance Y is not less than 1 mm.

Disclosure 9: The golf club according to any one of Disclosures 1 to 8, wherein each of the protrusions has a side surface having a triangular shape.

Disclosure 10: The golf club according to Disclosure 9, wherein each of the protrusions has a side surface on the opposite side to said side surface, and the triangular shape of said side surface is continued to the side surface on the other side as the cross-sectional shape of the protrusion, whereby on the side of the tip end of the tapered portion, the protrusion is merged into the insertion portion without forming a step.

Disclosure 11: The golf club according to any one of Disclosures 1 to 10, wherein each of the protrusions has a side surface having a trapezoidal shape.

Disclosure 12: The golf club according to Disclosure 11, wherein each of the protrusions has a side surface on the opposite side to said side surface, and the trapezoidal shape of said side surface is continued to the side surface on the other side as the cross-sectional shape of the protrusion, so that a non-tapered portion in which the protruding height is constant in the shaft axial direction is formed on the engaging portion side of the tapered portion.

Disclosure 13: A weight member for a golf club, which is configured to be attached to a first end of a tubular club shaft provided with a hollow therein and having said first end having a first inner diameter D1 and a second end on the opposite side of the first end, and which comprises:

an insertion portion to be disposed in the hollow, an engaging portion to be engaged with the first end on the outside of the shaft, and a plurality of protrusions protruding radially of the shaft from the insertion portion, wherein each of the protrusions is made of an elastically deformable material, the outer diameter D2 of the insertion portion is smaller than the first inner diameter D1 of the shaft, the maximum outer diameter D3 of the insertion portion including the protrusions is larger than the first inner diameter D1, each of the protrusions has a tapered portion in which the radially outwardly protruding height of the protrusion from the insertion portion is decreased toward the second end, and the length $L_t$ of each tapered portion measured along the axial direction of the shaft is more than 50% of the maximum length L of the protrusion measured along the axial direction of the shaft.

Disclosure 14: The weight member according to Disclosure 13, wherein in each of the protrusions, the length $L_t$ of the tapered portion is not less than 95% of the maximum length L of the protrusion.

Disclosure 15: The weight member according to Disclosure 13 or 14, wherein the centroid of each protrusion is positioned on the first end side of the middle position of the maximum length of the protrusion measured in the shaft axial direction.

Disclosure 16: The weight member according to Disclosure 13, 14 or 15, wherein each of the protrusions is spaced apart from the engaging portion by a distance Y in the shaft axial direction, and the distance Y is not less than 1 mm.

Disclosure 17: The weight member according to any one of Disclosures 13 to 16, wherein each of the protrusions has a side surface having a triangular shape.

Disclosure 18: The weight member according to Disclosure 17, wherein each of the protrusions has a side surface on the opposite side to said side surface, and the triangular shape of said side surface is continued to the side surface on the other side as the cross-sectional shape of the protrusion, whereby on the side of the tip end of the tapered portion, the protrusion is merged into the insertion portion without forming a step.

Disclosure 19: The weight member according to any one of Disclosures 13 to 16, wherein each of the protrusions has a side surface having a trapezoidal shape.

Disclosure 20: The weight member according to Disclosure 19, wherein each of the protrusions has a side surface on the opposite side to said side surface, and the trapezoidal shape of said side surface is continued to the side surface on the other side as the cross-sectional shape of the protrusion, so that a non-tapered portion in which the protruding height is constant in the shaft axial direction is formed on the engaging portion side of the tapered portion.

DESCRIPTION OF THE REFERENCE SIGNS

1 golf club
2 shaft
**2*a*** first end of shaft
**2*b*** second end of shaft
**2*i*** inner surface of shaft
5 weight member
**5*a*** first surface of weight member
6 tapered portion
51 insertion portion
52 engaging portion
53 protrusion
i hollow of shaft

What is claimed is:

1. A golf club comprising a tubular shaft and a weight member, wherein the tubular shaft is provided with a hollow therein and has a first end having a first inner diameter D1 and a second end on the opposite side of the first end, the weight member is attached to the first end, the weight member comprises:

an insertion portion disposed in the hollow, an engaging portion which is, on an outside of the tubular shaft, engaged with the first end, a plurality of protrusions protruding radially of the tubular shaft from the insertion portion, each of the protrusions is made of an elastically deformable material, an outer diameter D2 of the insertion portion is smaller than the first inner diameter D1 of the tubular shaft, a maximum outer diameter D3 of the insertion portion including the protrusions is larger than the first inner diameter D1, each of the protrusions has a tapered portion in which a radially outwardly protruding height of the protrusions from the insertion portion is decreased toward the second end, a length Lt of each tapered portion measured along an axial direction of the tubular shaft is more than 50% of a maximum length L of the protrusion measured along the axial direction of the tubular shaft, in a state of the weight member which is attached to the tubular shaft by inserting the insertion portion in the hollow, each of the protrusions at least partially contacts an inner surface of the tubular shaft in a state of being compressively elastically deformed, and a compression deformation rate of each protrusion given by (D3−D1)/D3×100 is in a range from 1% to 25%, wherein D1 is the first inner diameter of the tubular shaft, and D3 is the maximum outer diameter of the insertion portion including the protrusions.

2. The golf club according to claim 1, wherein in each of the protrusions, the length Lt of the tapered portion is not less than 95% of the maximum length L of the protrusion.

3. The golf club according to claim 1, wherein in a state of the weight member not mounted on the tubular shaft, a centroid of each protrusion is positioned on the first end side of a middle position of a maximum length L of the protrusion measured in the tubular shaft axial direction.

4. The golf club according to claim 1, wherein the protrusions are arranged at equal intervals in a circumferential direction of the tubular shaft.

5. The golf club according to claim 1, wherein each of the protrusions is spaced apart from the engaging portion by a distance Y in the tubular shaft axial direction, and the distance Y is not less than 1 mm.

6. The golf club according to claim 1, wherein each of the protrusions has a first side surface having a triangular shape.

7. The golf club according to claim 6, wherein each of the protrusions has a second side surface on an opposite side to the first side surface, and the triangular shape of the first side surface is continued to the second side surface on an other side as a cross-sectional shape of the protrusion, whereby on a side of a tip end of the tapered portion, the protrusion is merged into the insertion portion without forming a step.

8. A golf club comprising a tubular shaft and a weight member, wherein the tubular shaft is provided with a hollow therein and has a first end having a first inner diameter D1 and a second end on the opposite side of the first end, the weight member is attached to the first end, the weight member comprises:

an insertion portion disposed in the hollow, an engaging portion which is, on an outside of the tubular shaft, engaged with the first end, a plurality of protrusions protruding radially of the tubular shaft from the insertion portion, each of the protrusions is made of an elastically deformable material, an outer diameter D2 of the insertion portion is smaller than the first inner diameter D1 of the tubular shaft, a maximum outer diameter D3 of the insertion portion including the protrusions is larger than the first inner diameter D1, each of the protrusions has a tapered portion in which a radially outwardly protruding height of the protrusions from the insertion portion is decreased toward the second end, a length Lt of each tapered portion measured along an axial direction of the tubular shaft is more than 50% of a maximum length L of the protrusion measured along the axial direction of the tubular shaft, in a state of the weight member which is attached to the tubular shaft by inserting the insertion portion in the hollow, each of the protrusions at least partially contacts an inner surface of the tubular shaft in a state of being compressively elastically deformed, and a ratio W/S of a mass W in grams of the weight member and a total contact area S in sq·cm between the plurality of protrusions and the inner surface of the tubular shaft is not less than 2.0 but not more than 25.0.

9. A golf club comprising a tubular shaft and a weight member, wherein the tubular shaft is provided with a hollow therein and has a first end having a first inner diameter D1 and a second end on the opposite side of the first end, the weight member is attached to the first end, the weight member comprises:

an insertion portion disposed in the hollow, an engaging portion which is, on an outside of the tubular shaft, engaged with the first end, a plurality of protrusions protruding radially of the tubular shaft from the insertion portion, each of the protrusions is made of an elastically deformable material, an outer diameter D2 of the insertion portion is smaller than the first inner diameter D1 of the tubular shaft, a maximum outer diameter D3 of the insertion portion including the protrusions is larger than the first inner diameter D1, each of the protrusions has a tapered portion in which a radially outwardly protruding height of the protrusions from the insertion portion is decreased toward the second end, a length Lt of each tapered portion measured along an axial direction of the tubular shaft is more than 50% of a maximum length L of the protrusion measured along the axial direction of the tubular shaft, in a state of the weight member which is attached to the tubular shaft by inserting the insertion portion in the hollow, each of the protrusions at least partially contacts an inner surface of the tubular shaft in a state of being compressively elastically deformed, each of the protrusions has a first side surface having a trapezoidal shape, and each of the protrusions has a second side surface on an opposite side to the first side surface, and the trapezoidal shape of the first side surface is continued to the second side surface on an other side as a cross-sectional shape of the protrusion, so that a non-tapered portion in which the protruding height is constant in the tubular shaft axial direction is formed on an engaging portion side of the tapered portion.

10. A weight member for a golf club, which is configured to be attached to a first end of a tubular club shaft provided with a hollow therein and having said first end having a first inner diameter D1 and a second end on an opposite side of the first end, and which comprises:

an insertion portion to be disposed in the hollow, an engaging portion to be engaged with the first end on an outside of the tubular club shaft, and a plurality of protrusions protruding radially of the tubular club shaft from the insertion portion, wherein each of the protrusions is made of an elastically deformable material, an outer diameter D2 of the insertion portion is smaller than the first inner diameter D1 of the tubular club shaft, a maximum outer diameter D3 of the insertion portion including the protrusions is larger than the first inner diameter D1, each of the protrusions has a tapered portion in which a radially outwardly protruding height of the protrusion from the insertion portion is decreased toward the second end, a length Lt of each tapered portion measured along an axial direction of the tubular club shaft is more than 50% of a maximum length L of the protrusion measured along the axial direction of the tubular club shaft, and a compression deformation rate of each protrusion given by $(D3-D1)/D3\times100$ is in a range from 1% to 25%, wherein D1 is the first inner diameter of the tubular club shaft, and D3 is the maximum outer diameter of the insertion portion including the protrusions.

11. The weight member according to claim 10, wherein in each of the protrusions, the length Lt of the tapered portion is not less than 95% of the maximum length L of the protrusion.

12. The weight member according to claim 10, wherein a centroid of each protrusion is positioned on a first end side of a middle position of the maximum length L of the protrusion measured in the tubular club shaft axial direction.

13. The weight member according to claim 10, wherein each of the protrusions is spaced apart from the engaging portion by a distance Y in the tubular club shaft axial direction, and the distance Y is not less than 1 mm.

14. The weight member according to claim 10, wherein each of the protrusions has a first side surface having a triangular shape.

15. The weight member according to claim 14, wherein each of the protrusions has a second side surface on an opposite side to the first side surface, and the triangular shape of the first side surface is continued to the second side surface on an other side as a cross-sectional shape of the protrusion, whereby on a side of a tip end of the tapered portion, the protrusion is merged into the insertion portion without forming a step.

16. A weight member for a golf club, which is configured to be attached to a first end of a tubular club shaft provided with a hollow therein and having said first end having a first inner diameter D1 and a second end on an opposite side of the first end, and which comprises:

an insertion portion to be disposed in the hollow, an engaging portion to be engaged with the first end on an outside of the tubular club shaft, and a plurality of protrusions protruding radially of the tubular club shaft from the insertion portion, wherein each of the protrusions is made of an elastically deformable material, an outer diameter D2 of the insertion portion is smaller than the first inner diameter D1 of the tubular club shaft, a maximum outer diameter D3 of the insertion portion including the protrusions is larger than the first inner diameter D1, each of the protrusions has a tapered portion in which a radially outwardly protruding height of the protrusion from the insertion portion is decreased toward the second end, a length Lt of each tapered portion measured along an axial direction of the tubular club shaft is more than 50% of a maximum length L of the protrusion measured along the axial direction of the tubular club shaft, each of the protrusions has a first side surface having a trapezoidal shape, and each of the protrusions has a second side surface on an opposite side to the first side surface, and the trapezoidal shape of the first side surface is continued to the second side surface on an other side as a cross-sectional shape of the protrusion, so that a non-tapered portion in which the protruding height is constant in the tubular club shaft axial direction is formed on an engaging portion side of the tapered portion.

17. A weight member for a golf club, which is configured to be attached to a first end of a tubular club shaft provided with a hollow therein and having said first end having a first inner diameter D1 and a second end on an opposite side of the first end, and which comprises:

an insertion portion to be disposed in the hollow, an engaging portion to be engaged with the first end on an outside of the tubular club shaft, and a plurality of protrusions protruding radially of the tubular club shaft from the insertion portion, wherein each of the protrusions is made of an elastically deformable material, an outer diameter D2 of the insertion portion is smaller than the first inner diameter D1 of the tubular club shaft, a maximum outer diameter D3 of the insertion portion including the protrusions is larger than the first inner diameter D1, each of the protrusions has a tapered portion in which a radially outwardly protruding height of the protrusion from the insertion portion is decreased toward the second end, a length Lt of each tapered portion measured along an axial direction of the tubular club shaft is more than 50% of a maximum length L of the protrusion measured along the axial direction of the tubular club shaft, and a ratio W/S of a mass W in grams of the weight member and a total contact area S in sq·cm between the plurality of protrusions and the inner surface of the tubular club shaft is not less than 2.0 but not more than 25.0.

* * * * *